US008282402B2

(12) United States Patent
Ngo

(10) Patent No.: US 8,282,402 B2
(45) Date of Patent: Oct. 9, 2012

(54) CARD-EDGE CONNECTOR

(75) Inventor: Hung Viet Ngo, Harrisburg, PA (US)

(73) Assignee: FCI Americas Technology LLC, Carson City, NV (US)

( * ) Notice: Subject to any disclaimer, the term of this patent is extended or adjusted under 35 U.S.C. 154(b) by 77 days.

(21) Appl. No.: 12/967,364

(22) Filed: Dec. 14, 2010

(65) Prior Publication Data

US 2011/0151701 A1 Jun. 23, 2011

Related U.S. Application Data

(60) Provisional application No. 61/289,559, filed on Dec. 23, 2009.

(51) Int. Cl.
*H01R 12/00* (2006.01)

(52) U.S. Cl. ..... 439/79

(58) Field of Classification Search ..... 439/79, 439/80, 140, 141, 375
See application file for complete search history.

(56) References Cited

U.S. PATENT DOCUMENTS

| | | | | |
|---|---|---|---|---|
| 5,160,275 | A | 11/1992 | Nakamura et al. | |
| 5,415,573 | A | 5/1995 | Chen et al. | |
| 5,823,799 | A | 10/1998 | Tor et al. | |
| 6,358,079 | B1 | 3/2002 | Noble | |
| 6,468,089 | B1 * | 10/2002 | Hubbard et al. | 439/63 |
| 6,692,273 | B1 | 2/2004 | Korsunsky et al. | |
| 6,790,052 | B2 * | 9/2004 | Schmidgall et al. | 439/79 |
| 7,188,408 | B2 | 3/2007 | Korsunsky et al. | |
| 2001/0049212 | A1 * | 12/2001 | Arnett | 439/79 |
| 2003/0119349 | A1 * | 6/2003 | Bakker et al. | 439/140 |
| 2003/0207600 | A1 * | 11/2003 | Ho | 439/79 |
| 2004/0097118 | A1 * | 5/2004 | Takashita | 439/327 |

* cited by examiner

*Primary Examiner* — Tulsidas C Patel
*Assistant Examiner* — Phuongchi Nguyen
(74) *Attorney, Agent, or Firm* — Woodcock Washburn LLP

(57) ABSTRACT

A card-edge connector may provide a physically secure attachment to a substrate without the use of removable hardware. The card-edge connector may include a straddle-mount card-edge connector housing and a retention assembly that extends from the connector housing. The retention assembly configured to releasably secure the connector to the substrate.

15 Claims, 7 Drawing Sheets

CARD-EDGE CONNECTOR

CROSS-REFERENCE TO RELATED APPLICATIONS

This claims priority to U.S. Provisional Patent Application Ser. No. 61/289,559, filed Dec. 23, 2009, the disclosure of which is hereby incorporated by reference as if set forth in its entirety herein.

BACKGROUND

Electrical connector systems generally include circuits and components on one or more interconnected circuit boards. Examples of circuit boards in an electrical connector system can include daughter boards, motherboards, backplane boards, midplane boards, or the like. Electrical assemblies can further include an electrical connector that provides an interface between electrical components, and provide electrically conductive paths for electrical communications data signals and/or electrical power so as to place the electrical components in electrical communication with each other.

For instance, referring to FIG. 1, a conventional electrical connector system 101 includes en electrical card-edge connector 100 electrically connected between a first and second printed circuit board 102 and 104. The connector 100 is illustrated as a straddle-mount style card-edge connector 100 that provides an electrically conductive path between traces proximate to an edge of the first printed circuit board 102 and traces proximate to an edge of the second printed circuit board 104, which is illustrated as being co-planar with the first printed circuit board 102. Such a configuration may be well suited for an electrical connector system in an enclosure, such as a 1U rack-mount server.

The electrical card-edge connector 100 can further be physically secured to at least one or both of the first and second printed circuit boards 102 and 104 to which it electrically connects. For instance, the electrical connector system 101 can further include hardware 106 such as screws, nuts, and the like, that provides a secure physical connection between the electrical card-edge connector 100 and the first printed circuit board 102. Unfortunately, substantial time and resources are associated with the attachment and removal of the hardware 106 when connecting and disconnecting the electrical card-edge connector 100 to and from the first printed circuit board 102, for instance when constructing the electrical connector system 101, thereby increasing the manufacturing cost and mean-time-to-repair the electrical connector system 101.

What is therefore desired is an electrical connector having a simplified apparatus that is configured to be physically secured to a complementary electrical component.

SUMMARY

In accordance with one embodiment, a card-edge connector is configured to be mounted to a substrate along an insertion direction. The card-edge connector includes a connector housing that carries a plurality of electrical contacts, and at least one latch member. The latch member includes a latch arm that is connected to the connector housing at a first location, and a latch body extending from the latch arm at a second location that is spaced from the first location along a direction opposite to the insertion direction.

BRIEF DESCRIPTION OF THE DRAWINGS

The foregoing summary, as well as the following detailed description of the preferred embodiments of the application, will be better understood when read in conjunction with the appended drawings. For the purposes of illustrating an electrical connector system, there are shown in the drawings preferred embodiments. It should be understood, however, that the instant application is not limited to the precise arrangements and/or instrumentalities illustrated in the drawings, in which.

DETAILED DESCRIPTION

Figure 2A:
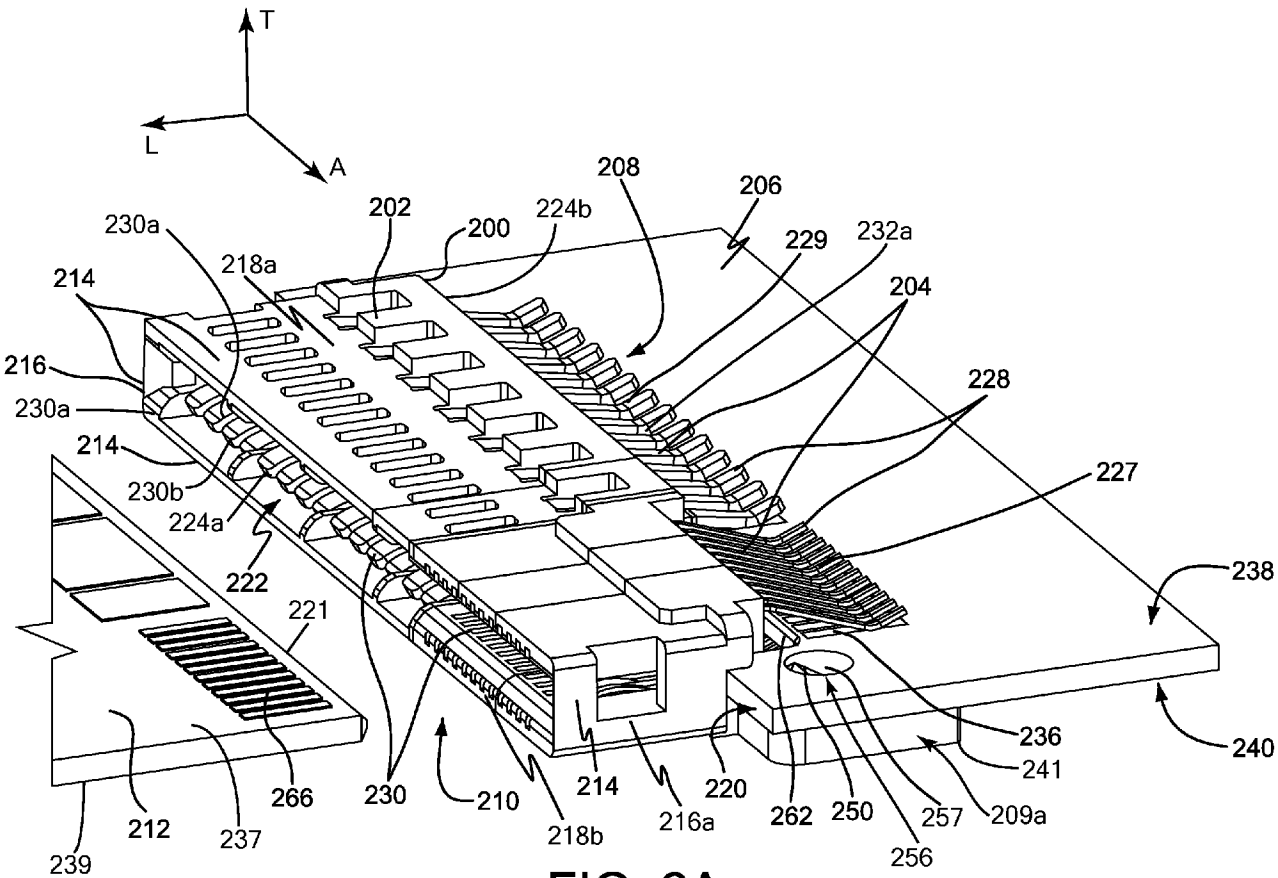
FIG. 2A is a perspective assembly view of an electrical connector system constructed in accordance with one embodiment, including an electrical connector electrically connected and physically secured to a first printed circuit board, and configured to electrically connect to a second printed circuit board.
Figure 2B:
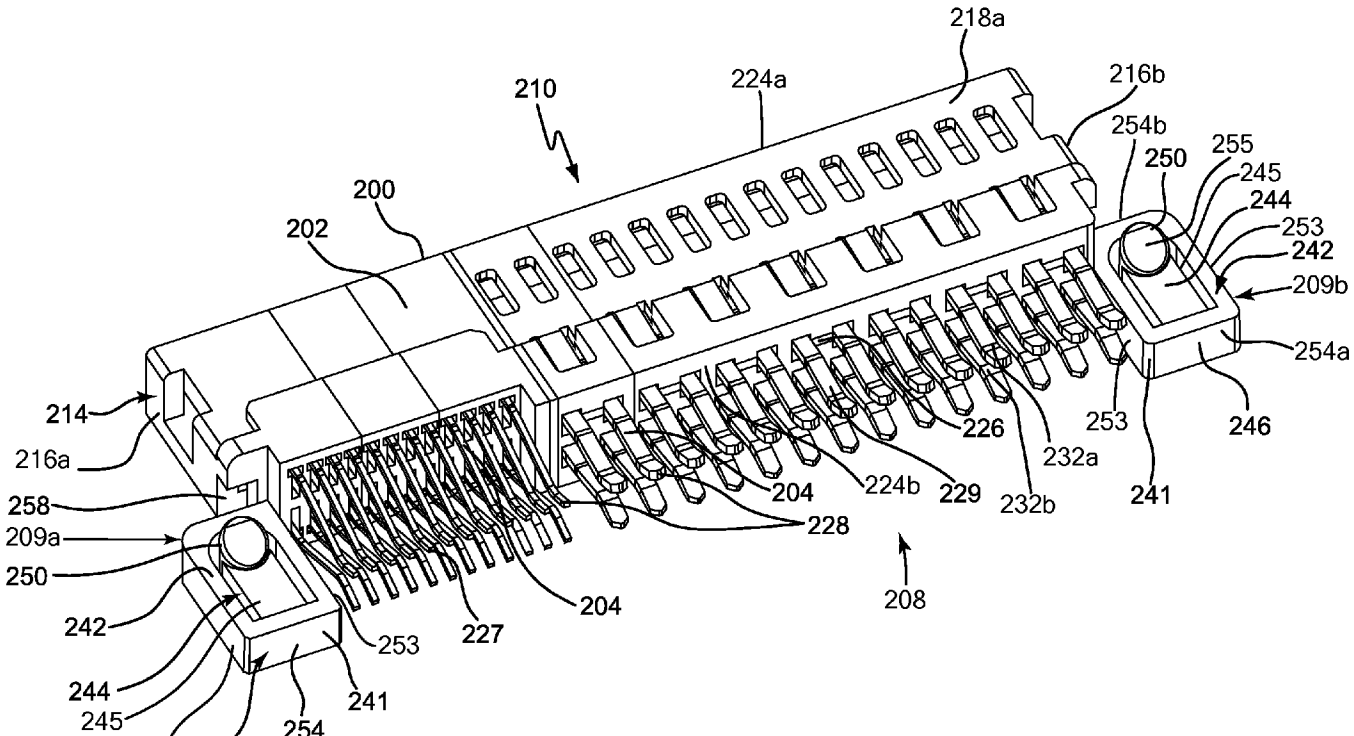
FIG. 2B is a rear perspective view of the electrical connector illustrated in FIG. 2A, including a retention assembly configured to physically secure the electrical connector to the first printed circuit board.
Figure 2C:
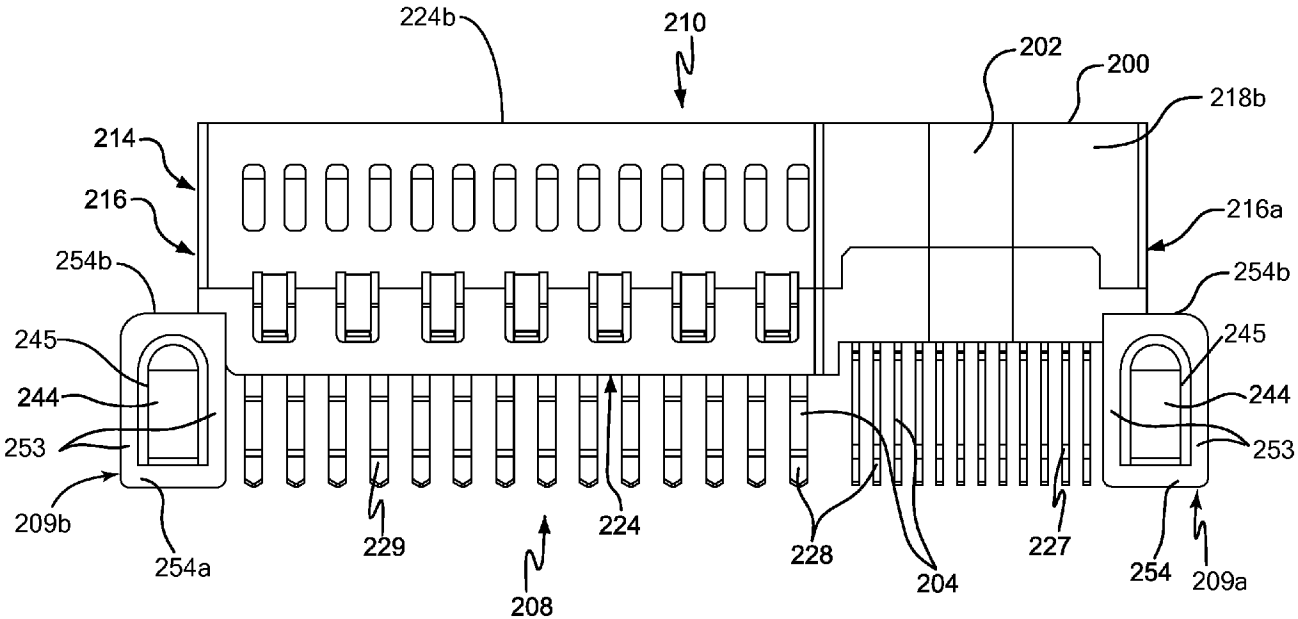
FIG. 2C is a bottom plan view of the electrical connector illustrated in FIG. 2B.

One aspect of the present disclosure provides a retention assembly that is configured to physically secure a card-edge connector to a printed circuit board without the use of removable hardware. Referring to FIGS. 2A-C, an electrical connector system 201 includes an electrical connector 200 and first and second complementary electrical components illustrated as a first substrate such as a first printed circuit board 206 and a second substrate such as a second printed circuit board 212, such that the electrical connector 200 is configured to attach to the first printed circuit board 206 and a second printed circuit board 212. The electrical connector 200 is illustrated as a card-edge connector, and can be configured as a straddle-mount connector in accordance with the illustrated embodiment.

The electrical connector 200 includes a connector housing 202 that carries at least one electrical contact 204 such as a plurality of electrical contacts 204 that are configured to electrically connect to complementary electrical traces on the first and second printed circuit boards 206 and 212 so as to place the first and second printed circuit boards 206 and 212 in electrical communication with each other. In particular, the electrical connector 200 defines a mounting interface 208 configured to engage the first printed circuit board 206. For example, the mounting interface 208 may be a straddle-mount interface. When the electrical connector 200 is mounted to the first printed circuit board 206, the electrical contacts 204 are electrically connected to the first printed circuit board 206 and the connector housing 202 is physically secured to the first printed circuit board 206 such that the electrical contacts 204 remain electrically connected to the first printed circuit board 206. For instance, as will be appreciated from the description below, the connector housing 202 can be removably physically secured to the first printed circuit board 206. The electrical connector 200 further defines a mating interface 210 configured to mate with the second printed circuit board 212. When the electrical connector 200 is mated to the second printed circuit board 212, the electrical contacts 204 are electrically connected to the second printed circuit board 212, and the connector housing 202 is physically attached to the second printed circuit board 212.

The connector housing 202 may be made of a dielectric material, such as a plastic, for example a high temperature thermoplastic. The connector housing 202 can be configured as a straddle-mount card-edge housing. The connector housing 202 may have one or more walls 214 that define an internal chamber 222 that can also be referred to as a contact support chamber, such that the electrical contacts 204 are supported by the connector housing 202 in the internal chamber 222. For instance, the connector housing includes a first side wall 216*a* and an opposed second side wall 216*b* spaced from the first side wall 216*a* along a lateral direction A, an upper wall 218*a* and an opposed lower wall 218*b* spaced from the upper wall 218*a* along a transverse direction T that extends substantially perpendicular with respect to the lateral direction A, and a front wall 224*a* that can at least partially define the mating interface 210, and an opposed rear wall 224*b* spaced from the front wall 224*a* along a longitudinal direction L that extends substantially perpendicular with respect to both the lateral direction A and the transverse direction T. The rear wall 224*b* can at least partially define the mounting interface 212.

When the electrical connector 200 is oriented as illustrated, the longitudinal direction L and the lateral direction A extend horizontally, and the transverse direction T extends vertically, though it should be appreciated that these directions may change depending, for instance, on the orientation of the electrical connector 200 during use. Unless otherwise specified herein, the terms "lateral," "longitudinal," and "transverse" are used to describe the perpendicular directional components of various components. The terms "inboard" and "inner," and "outboard" and "outer" with respect to a specified directional component are used herein with respect to a given apparatus to refer to directions along the directional component toward and away from the center apparatus, respectively. The longitudinally forward direction can also be referred to an insertion direction, as the electrical connector 200 can be mounted to the first printed circuit board 206 along a longitudinally rearward insertion direction 300 (see FIG. 3A), and can further be mated to the second printed circuit board 212 along a longitudinally forward direction opposite the rearward insertion direction 300.

The electrical contacts 204 can each define respective mounting ends 228 disposed proximate to the mounting interface 208 of the connector housing 202 and configured to be placed in electrical communication with complementary electrical traces 236 of the first printed circuit board 206 so as to place the electrical contacts 204 in electrical communication with the first printed circuit board 206. The electrical contacts 204 further define mating ends 230 that are opposed to the mounting ends 228 and disposed proximate to the mating interface 210 and configured to be placed in electrical communication with complementary electrical traces 266 of the second printed circuit board 212. Accordingly, when the electrical contacts 204 are mounted and mated to the first and second printed circuit boards 206 and 212, respectively, an electrically conductive path may be established from and between the electrically conductive traces 236 on the first printed circuit board 206, through respective electrical contacts 204, and respective electrically conductive trace 266 of the second printed circuit board 212. the first and second circuit boards 206 and 121 are placed in electrical communication. Because the mating interface 210 is oriented substantially parallel with respect to the mounting interface 208, the electrical connector 200 can be referred to as a vertical electrical connector, and the electrical contacts 204 can be referred to as vertical electrical contacts. Moreover, as will be appreciated from the description below, the electrical connector 200 can be mated and mounted to the first and second printed circuit boards 206 and 212, respectively, such that the printed circuit boards 206 and 212 extend substantially parallel to or co-planar with each other.

The first and second printed circuit board 206 and 212 define respective leading edges 220 and 221 that extend laterally and are configured to engage the electrical connector 200 along the longitudinal insertion direction. For instance, the leading edge 220 of the first printed circuit board 206 is configured to be received by the mating ends 228 of the electrical contacts 224, and the leading edge 221 of the second printed circuit board 212 is configured to be received by the mating ends 230 of the electrical contacts 230 so as to place the respective electrical traces 236 and 266 in electrical communication with the electrical contacts 224 and each other. In accordance with the illustrated embodiment, the front wall 224*a* can define a front opening 225 of the internal chamber 222 that is disposed proximate to the mating interface 210 and is configured to receive the second printed circuit board 212. Furthermore, in accordance with the illustrated embodiment, the rear wall 224*b* can substantially close the rear end of the internal chamber 222 that is disposed proximate to the mounting interface 208, and defines at least one opening 226 such as a plurality of openings 226 through which one or more of the contacts 204 extend such that the mounting ends 228 extend out from the connector housing 202. When the mounting interface 208 is mounted to the first printed circuit board 206 and mated with the second printed circuit boards 206, the side walls 216*a-b* extend substantially longitudinally and substantially perpendicular with respect to the respective leading edges 220 and 221, and the front and rear walls 224*a-b* extend substantially laterally and substantially parallel to the respective leading edges 220 and 221.

The mating ends 230 of the electrical contacts 204 can be carried by the connector housing 202 within the internal chamber 222, and include transversely opposed resilient fingers 230*a-b* that are configured to straddle the leading edge 221 of the second printed circuit board 212 when the second printed circuit board 212 is inserted into the cavity 222 of the mating interface 210. The mounting ends 228 of the contacts 204 extend through the rear wall 224 of the connector housing 202 and longitudinally out from the connector housing 202. Each respective mounting end 228 may define transversely opposed resilient fingers 232*a-b* that can be flared away from each other at their distal tips so as to provide guidance when mounting the electrical connector 200 to the first printed circuit board 206 (see FIGS. 3A-C).

When the electrical connector 200 is electrically connected to the first printed circuit board 206, the fingers 232*a-b* of the mounting end 228 of the contacts 204 may straddle the leading edge 220 of the first printed circuit board 206. The electrical traces 236 may be disposed on an upper surface 238 and/or a bottom surface 240 of the first printed circuit board 206. Thus, when the electrical connector 200 is electrically connected to the first printed circuit board 206, the mounting ends 228 of the electrical contacts 204 may pinch the upper surface 238 and bottom surface 240 of the first printed circuit board 206 and establish an electrically conductive path with the respective electrical traces 236. Likewise, when the electrical connector 200 is electrically connected to the second printed circuit board 212, the fingers 230*a-b* of the mating ends 230 of the electrical contacts 204 may straddle the leading edge 221 of the second printed circuit board 212. The electrical traces 266 may be disposed on an upper surface 237 and/or a bottom surface 239 of the second printed circuit board 212. Thus, when the electrical connector 200 is electrically connected to the second printed circuit board 212, the mating ends 230 of the electrical contacts 204 may pinch the upper surface 237 and bottom surface 239 of the second printed circuit board 212 and establish an electrically conductive path with the respective electrical traces 266.

The electrical contacts 204 may be made of any electrically conductive material, such as a copper alloy, and can be configured in a first group of electrical signal contacts 227 disposed proximate to the first side wall 216*a* that are configured to transmit electrical communication or data signals between the first and second printed circuit boards 206 and 212, and a second group of electrical power contacts 229 disposed adjacent the electrical signal contacts 227 and proximate to the second side wall 216*b*. The electrical connector 200 can further include ground contacts disposed adjacent select ones of the signal contacts 227 as desired. The electrical power contacts 229 can be configured to transmit power between the first and second printed circuit boards 206. The power contacts 229 may be sized larger than the signal contacts 227 so as to carry DC and/or AC power. In one embodiment, the power contacts 229 are rated at around 7 A per each contact at 30° C. T-Rise in still air with a voltage rating of 1000V AC.

The electrical connector 200 includes at least one retention assembly such as first and second retention assemblies 209*a-b* that are supported by the electrical connector housing 202 and disposed proximate to the mounting interface 208. The retention assemblies 209*a-b* can be substantially identically constructed, and configured symmetrical to each other. For instance, in accordance with the illustrated embodiment, the retention assemblies 209*a-b* are configured as ears that extend laterally outward from the first and second laterally opposed side walls 216*a-b*, respectively, and longitudinally rearwardly out from the rear wall 224*b*. Accordingly, the retention assemblies 209*a-b* are disposed on opposed lateral sides of the electrical contacts 204, such that the electrical contacts 204 are disposed between the engagement members 209*a-b*. For instance, the first retention assembly 209*a* is disposed laterally outward with respect to the electrical signal contacts 227, and the second retention assembly 209*b* is disposed laterally outward with respect to the electrical power contacts 209. Each of the retention assemblies 209*a-b* is configured to physically secure the connector housing 202, and thus the electrical connector 200, to the first printed circuit board 206. In accordance with one embodiment, each of the retention assemblies 209*a-b* is configured to releasably secure the connector housing 202 to the first printed circuit board 206.

Each retention assembly 209*a-b* includes a platform 241 having an upper platform surface that defines a support surface 242 configured to abut or face or otherwise support the bottom surface 240 of the first printed circuit board 206 when the electrical connector 200 is physically secured to the first printed circuit board 206. Each retention assembly 209*a-b* further defines an aperture in the form of a latch chamber 243 that extends transversely into the support surface 242 so as to define an outer frame 246 that can define a rectangular shape or any suitable alternative shape as desired, and a configured to support the bottom surface 240 of the first printed circuit board 206. Thus, the outer frame 246 surrounds the latch chamber 243, which can provide a latch chamber in accordance with the illustrated embodiment. For instance, the outer frame 246 can include a leading end wall 254*a* in the direction of insertion and a longitudinally opposed trailing end wall 254*b*, and a pair of laterally opposed sides 253 connected between the leading and trailing walls 254*a-b*.

Each of the retention assemblies 209*a-b* can further include at least one engagement member such as a latch member 244 that can be resilient, carried by the platform 241, and at least partially disposed in the latch chamber 243. The latch member 244 is configured to interlock with a complementary engagement member of the first printed circuit board 206, such as an aperture 256 which can be referred to as a mounting aperture that extends transversely through the first printed circuit board 206. Each latch member 244 includes a flexible latch arm 245 that is connected to the frame 246 at a proximal end, and defines an opposed distal free end that carries a latch body that is illustrated as a post 250 but could have any suitable alternatively configuration as desired, such as a hook. Thus, it can be said that the latch body, such as the post 250, is supported or carried by the connector housing 202.

The latch arm 245 extends along a direction opposite the insertion direction 300 such that the distal free end that carries the latch body, such as the post 250, is disposed opposite the proximal end along the direction that is opposite the insertion direction 300. It should be appreciated that while the proximal end of the latch arm 245 can be indirectly connected to the connector housing 202 via the frame 246, the proximal end of the latch arm 245 can alternatively be directly connected to the connector housing 202 as desired. Whether the proximal end of the latch arm 245 is connected to the connector housing 202 directly or indirectly, it can be said that the latch arm 245 defines a proximal end that is connected to the connector housing, and the latch arm defines a latch arm body that extends from the proximal end along a direction opposite the insertion direction 300 to a free distal end that carries a latch body, such as the post 250. The free distal end can of the latch arm 245 thus be spaced from the proximal end of the latch arm 245 along a direction that is opposite the insertion direction 300. It should be appreciated that while the latch body, such as the post 250 is illustrated as disposed at the free distal end of the latch arm 245, the latch body can be disposed anywhere along the latch arm body between the free distal end and the proximal end, or can be disposed substantially at or proximate to the proximal end of the latch arm 245. It can thus be said that the latch arm 245 is connected to the connector housing 202, directly or indirectly, integrally or discretely, at a first location, and the latch body, such as the post 250, that is configured to secure the electrical connector 200 to the first printed circuit board 206, extends from the latch arm 245 at a second location that is spaced from the first location along a direction that is opposite the insertion direction 300. The first location can define the proximal end of the latch arm 245 or any other location along the latch arm 245, and the second location can define the free distal end of the latch arm 245 or any other location along the latch arm 245. Accordingly, in accordance with one embodiment, the latch arm 245 can be placed in tension as opposed to another embodiment where the latch member 244 has a latch body that spaced from a location connected to the connector housing 202 along the insertion direction, which could tend to place the latch arm 245 in compression as the electrical connector 200 is mounted to the first printed circuit board 206 and possibly subject the latch arm 245 to buckling.

In accordance with the illustrated embodiment, the post 250 is substantially cylindrical and extends up from the latch arm 245, for instance at the distal free end, and defines an engagement surface 255 that can define an upper engagement surface that is configured to ride along the lower surface 240 of the first printed circuit board 206. The engagement surface 255 can be beveled such that the leading end of the engagement surface 255 is disposed below the trailing end of the engagement surface 255. Otherwise stated, the engagement surface 255 is tapered transversely inward or down along a direction from the trailing end toward the leading end, or in a longitudinally rearward direction toward the first printed circuit board 206, such that the support surface 242 is aligned with a portion of the engagement surface 255, for instance between the leading end and the trailing end of the engagement surface 255.

It can thus be said that the engagement surface 255 defines a leading end and an opposed trailing end along the insertion direction 300. The engagement surface 255 can be tapered along the insertion direction 300 as illustrated. Accordingly, before the electrical connector 200 is mounted to the first printed circuit board 206, the leading end is disposed on a first side of a plane defined by the surface of the first printed circuit board 206 that the engagement surface 255 rides along when mounting the electrical connector 200 to the first printed circuit board 206 (e.g., the lower surface 240), and the trailing end is disposed on a second opposite side of the plane. For instance, the leading end of the engagement surface 255 is located on the same side of the plane defined by the lower surface 240 of the first printed circuit board 206, whereas the trailing end of the engagement surface 255 is disposed on the opposite side of the plane defined by the lower surface 240. As the electrical connector 200 is mounted to the first printed circuit board 206, the trailing end of the engagement surface 255 is biased by the first printed circuit board 206 across the plane to the first side of the plane, such that the trailing end rides along the surface of the first printed circuit board 206 that defines the plane (e.g., the lower surface 240). It should be appreciated that the plane can alternatively be defined by the upper surface 238 of the printed circuit board 206 as desired.

As illustrated in FIGS. 2A-C, the latch member 244 is connected to the leading end wall 254*a*, and the latch arm 245 extends longitudinally forward away from the first printed circuit board 206. Because the post 250 is therefore disposed longitudinally forward with respect to the leading end wall 254*a*, the corresponding apertures 256 can be located proximate to the leading edge 220, thereby improving circuit board layout allowing for greater contiguous surface space for denser routing toward the center of the first printed circuit board 206 compared to a configuration whereby the apertures 256 are further spaced from the leading edge 220. It should be appreciated, however, that the latch member 244 may alternatively extend from the frame 246 at any location, for instance at any of the walls 253 and 254*a-b*.

During operation, when the electrical connector 200 is mounted to the first printed circuit board 206, the support surface 242 of the platform 241 may be substantially flush with and abut the bottom surface 240 of the first printed circuit board 206. The latch arm 245 may be flexible and resilient when pressure is applied to the post 250 in the upward or downward direction. Accordingly, the latch member 244, and in particular the latch arm 245, can flex between a relaxed or unflexed position and a flexed position, whereby the post 250 is displaced transversely down as the latch arm 245 flexes. When the latch member 244 is in the relaxed position, the latch member 244 and/or a portion of the post 250 may be disposed above the support surface 242 of the platform 241. For instance, a first leading portion of the engagement surface 255 can be disposed below the support surface 242 of the platform 241, while a second trailing portion of the engagement surface 255 can be disposed above the support surface 242 of the platform 241 when in the latch member 244 is in the relaxed position. Thus, when the latch member 244 is in its relaxed position, at least a portion of the engagement surface 255 is disposed above the bottom surface 240 of the first printed circuit board 260 when the first printed circuit board 260 is aligned with the mounting 228 of the electrical contacts 204. When a biasing force is applied to the post 250 in the downward direction, for instance, the latch member 244, and in particular the latch arm 245, iterates to the flexed position, whereby the post 250, and thus the engagement surface 255, is displaced so as to be transversely recessed with respect to the relaxed position. For instance, when in the flexed position, a substantial entirety of the engagement surface 255, including the trailing end, is substantially flush with and/or disposed below the support surface 242 of the platform 241, and thus below the bottom surface 240 of the printed circuit board 206 as the electrical connector 200 is being mounted to the first printed circuit board. Otherwise stated, when in the flexed position, a substantial entirety of the engagement surface 255, including the trailing end, does not extend above the support surface 242 of the platform 241. When the biasing force is released, the latch arm 245 is biased to flex back upward, thereby applying a biasing force to the post 250 that urges the post 250 to its position when the latch member 244 is in the neutral position.

The first printed circuit board 206 includes a pair of engagement members that are complementary to the retention assemblies 209*a-b*. For instance, the first printed circuit board 206 defines a pair of apertures 256 that extends vertically through the first printed circuit board 206, such that each aperture 256 is defined by an inner surface 257 of the first printed circuit board 206. The inner surface 257 can be substantially circular in cross-section, such that the aperture 256 can be substantially cylindrical, though it should be appreciated that the inner surface 257 and aperture 256 can be sized and shaped as desired so as to correspond to the size and shape of the post 250. For instance, the inner surface 257 is sized and shaped substantially equal to, or slightly greater than, the outer periphery of the post 250 such that the post 250 may be biased into the corresponding aperture 256 when the electrical connector 200 is mounted to the first printed circuit board 206. For instance, the post 250 can ride along a surface of the first printed circuit board 206, such as the bottom surface 240, and can be subsequently biased into the aperture 256 by the latch arm 245 when the electrical connector 200 is mounted to the first printed circuit board.

Figure 1:
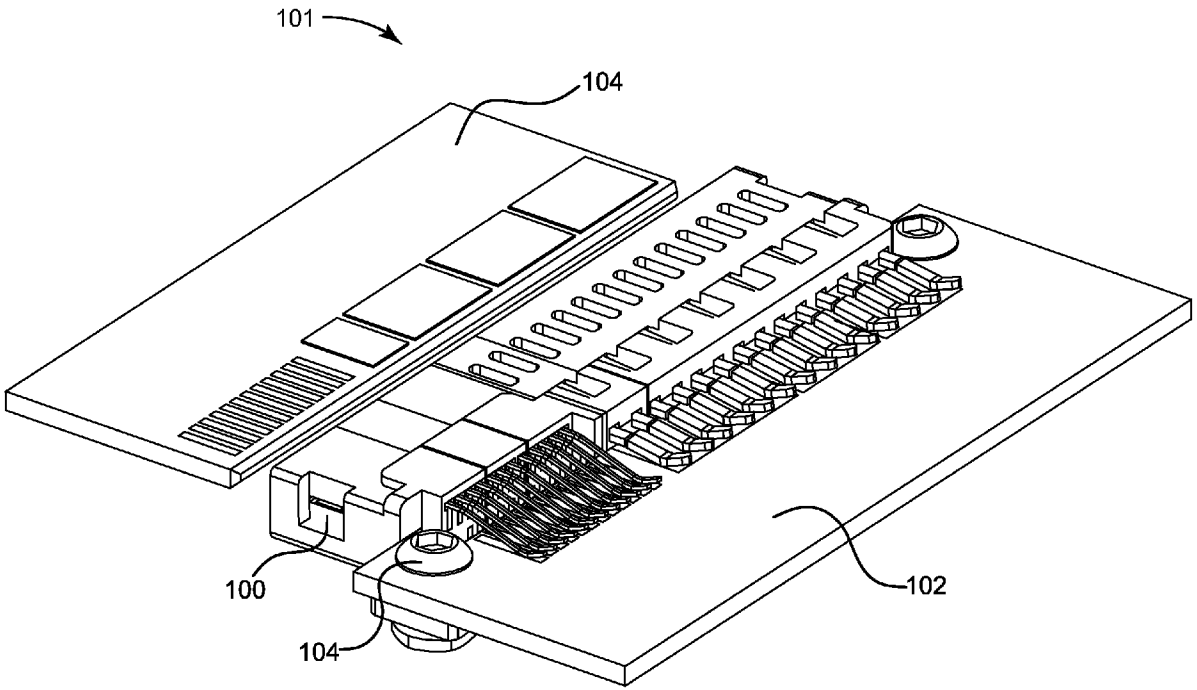
FIG. 1 PRIOR ART
FIG. 1 is a perspective view of an electrical connector system including a straddle-mount card-edge connector connected between a pair of circuit boards in accordance with the prior art.

The aperture 256 may be disposed within the first printed circuit board 206 at a location suitable to provide connections to both card-edge connectors 100 that use hardware such as screws and the like as illustrated in FIG. 1, as well as for card-edge connectors 200 that include at least one resilient latch member as described herein. As a result, the card-edge connector 200 may be retrofit into a pre-existing electrical connector system, and in particular can replace conventional connectors that are attached to circuit boards using hardware such as hardware 106.

Figure 4A:
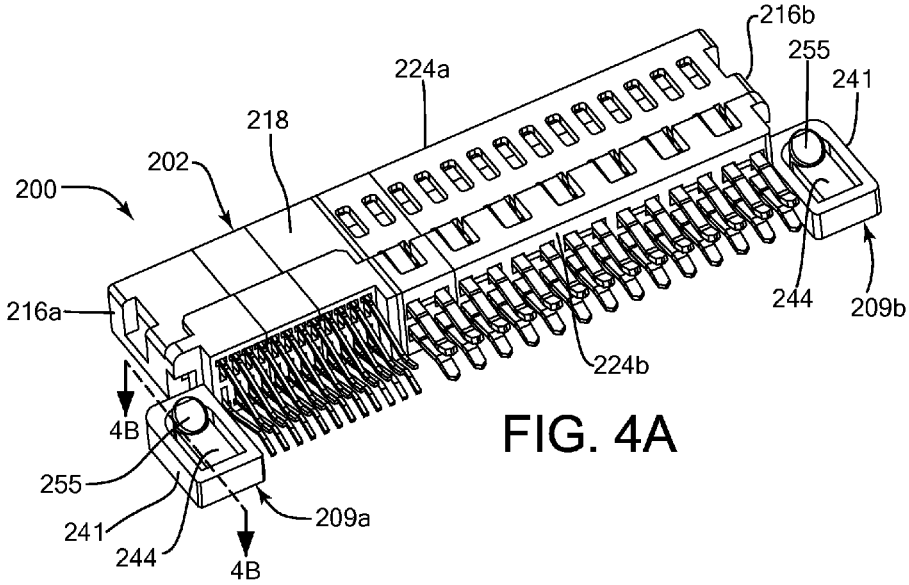
FIG. 4A is a front perspective view of the electrical connector illustrated in FIG. 2A.
Figure 4B:
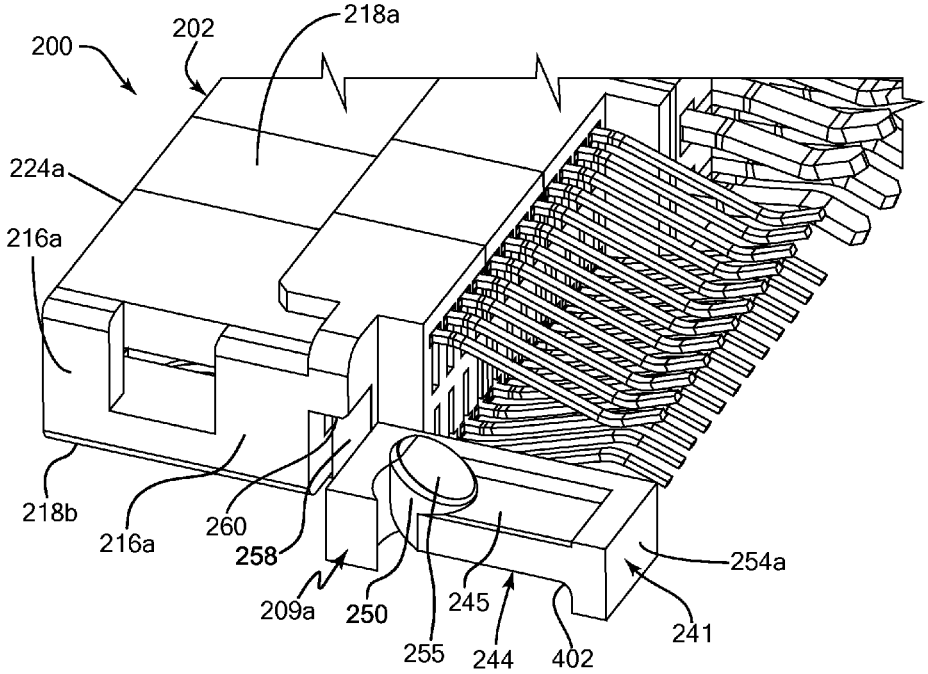
FIG. 4B is an enlarged perspective view of the electrical connector as illustrated in FIG. 4A, but with a section removed along line 4B-4B.

Referring to FIGS. 4A-B, the latch arm 245 can define a curved bottom interface 402 to the leading end wall 254*a* at its proximal end. The curved bottom interface 402 can assist in the resilient flexing of the latch arm 245 between the neutral position and the flexed position. The frame 241, and for instance the trailing end wall 254*b*, can be spaced from the post 250 a sufficient distance so as to provide adequate clearance for the post 250 as the post 250 iterates between the relaxed and flexed positions.

With continuing reference to FIGS. 4A-B, the connector housing 202 may define at least one retention pocket such as first and second laterally opposed retention pockets 258 that are sized to receive the leading edge 220 of the first printed circuit board 206 and operably aligned with the retention assemblies 209*a-b* such that the retention pockets 258 receive the first printed circuit board 206 as the retention assemblies 209*a-b* physically secure the electrical connector 200 to the first printed circuit board 206. In accordance with the illustrated embodiment, the pockets 258 are disposed behind the retention assemblies 209*a-b* with respect to the insertion direction.

The connector housing 202 can define the retention pockets 258 such that the retention pockets 258 extend longitudinally into the rear wall 224*b* and further extend laterally outward through the adjacent side wall 216*a* and 216*b*. The retention pockets 258 are laterally opposed, and can be positioned in longitudinal alignment with the respective latch members 244, such that a line extending longitudinally along the insertion direction 230 through the latch member 244 also passes through the corresponding retention pocket 258. The connector housing 202 can include an upper internal surface 260 that at least partially defines the retention pockets 258, for instance an upper perimeter of the retention pocket 258. The connector housing 202 thus defines a transverse height from the support surface 242 of the platform 241 that can be substantially equal to the transverse thickness of the first printed circuit board 206 between the upper and lower surfaces 238 and 240.

Thus, when the electrical connector 200 is mounted to the first printed circuit board 206, a portion of the leading edge 220 can be received into the retention pocket 258. For instance, the first printed circuit board 206 can define a notch 262 that defines at least one leading corner portion 264 of the leading edge 220, such as a pair of laterally opposed leading corner portions 264 of the leading edge 220, such that a middle portion of the leading edge 220 extends laterally between the corner portions 264 and is longitudinally recessed with respect to the corner portions 264. The upper surface 238 of the first printed circuit board 206 can abut the upper inside surface 260 of the connector housing 202 that defines the upper end of the retention pocket 258, and the support surface 242 of the platform 241 abuts the bottom surface 240 of the first printed circuit board 206. Accordingly, it can be said that the upper inside surface 260 is configured to abut the upper surface 238 of the first printed circuit board 206 when the electrical connector 200 is mounted to the first printed circuit board 206, and the support surface 242 of the platform 241 is configured to abut the bottom surface 240 of the first printed circuit board 206 when the electrical connector 200 is mounted to the first printed circuit board 206. Therefore, the support surface 242 of the platform 214 and the upper internal surface 260 can be referred to as opposed engagement surfaces that are configured to engage or opposed first and second surfaces of the first printed circuit board 206, such as the bottom and upper surfaces 240 respectively, thereby capturing the first printed circuit board 206 therebetween. In accordance with the illustrated embodiment, the mounting ends 228 of the electrical contacts 204 are disposed forward with respect to the retention pockets 258 with respect to the insertion direction 300.

In accordance with the illustrated embodiment, when the electrical connector 200 is mounted to the first printed circuit board 206, the corner portions 264 of the first printed circuit board 206 are received in the retention pockets 258, thereby providing additional stabilization to the physical securement of the electrical connector 200 and the first printed circuit board 206. The upper inner surface 260 of the retention pocket 258 may be smaller than the support surface 242 of the platform 241. As a result, the smaller upper inner surface 260 may provide physical stability while preserving valuable surface space on the first printed circuit board 206.

Figure 3A:
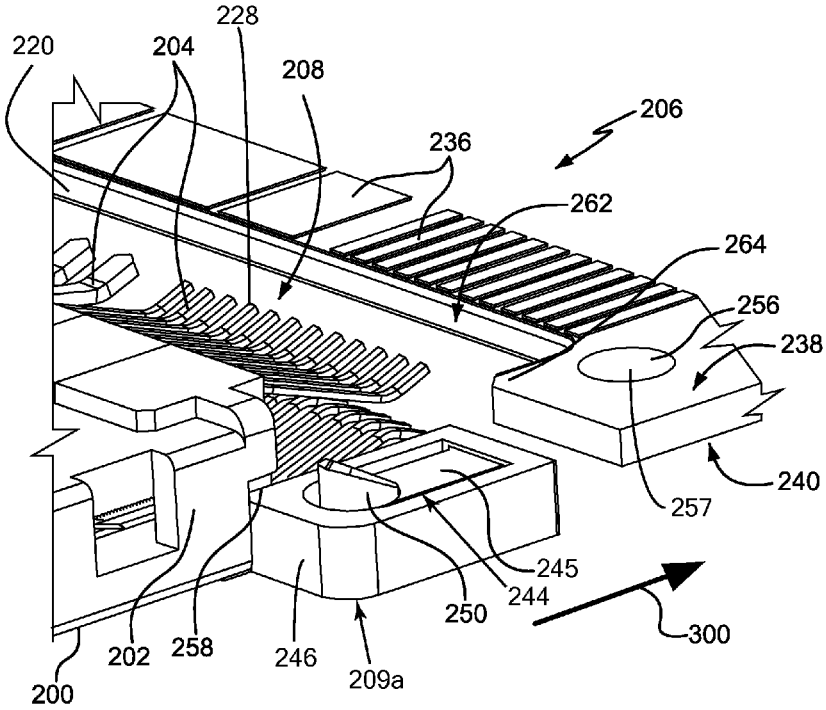
FIG. 3A is a perspective view of a portion of the electrical connector system illustrated in FIG. 2A, showing the electrical connector aligned with and configured mount to the first printed circuit board.
Figure 3B:
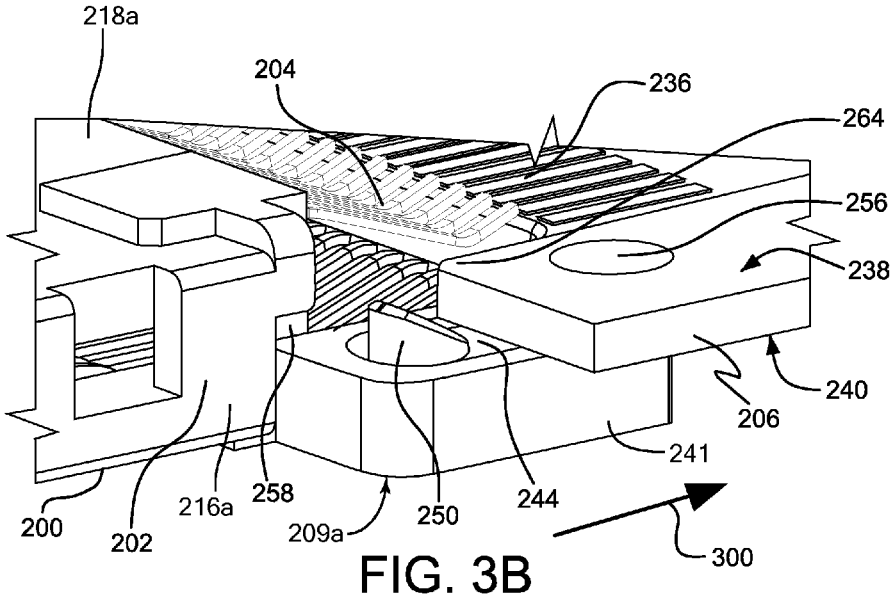
FIG. 3B is a perspective view of the portion of the electrical connector system as illustrated in FIG. 3A, showing the electrical connector and the second printed circuit board in a partially mounted configuration.
Figure 3C:
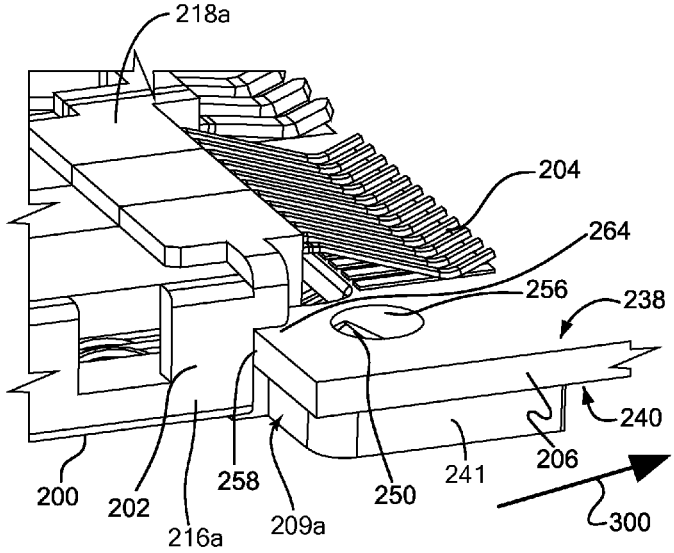
FIG. 3C is a perspective view of the portion of the electrical connector system as illustrated in FIG. 3B, showing the electrical connector and the second printed circuit board in a fully mounted configuration.

Referring now to FIGS. 3A-C, a method of mounting the electrical connector 200 to the first printed circuit board 206 is described with reference to the first retention assembly 209*a*, it being appreciated that the description applies equally to the second retention assembly 209*b*, which can be constructed substantially identically to the first retention assembly 209*a*. For instance, the electrical connector 200 can be attached to the first printed circuit board 206 by imparting a relative longitudinal motion on at least one of the electrical connector 200 and circuit board 206 such that the mounting interface 208 of the electrical connector 200 moves relative to the first printed circuit board 206 along the longitudinal insertion direction 300 and the mounting interface 208 receives the leading edge 220 of the first printed circuit board 206 until the mounting ends 228 of the electrical contacts 204 electrically connect to the complementary electrical traces 236 of the first printed circuit board, and the retention assemblies 209*a-b* physically secure the electrical connector 200 to the first printed circuit board 206.

As illustrated in FIG. 3A, the mounting interface 208 of the electrical connector 200 may be aligned with the leading edge 220 of the first printed circuit board 206, such that the mounting ends 228 of the electrical contacts 204 are positioned to engage the leading edge 220 of the first printed circuit board 206 by moving at least one of the electrical connector 200 and the first printed circuit board 206 such that the electrical connector 200 moves relative to the first printed circuit board 206 along the longitudinal insertion direction 300. For instance, when the mounting interface 208 of the electrical connector 200 is aligned with the leading edge 220 of the first printed circuit board 206, the bottom surface 240 of the first printed circuit board 206 may be aligned with the support surface 242 of the platform 242. Furthermore, each latch post 250 can be aligned with the complementary aperture 256 of the first printed circuit board 206 along the insertion direction 300.

Referring now to FIG. 3B in particular, the electrical connector 200 and circuit board 206 move relative to each other, such that the connector advances toward the circuit board in the insertion direction 300. In particular, the electrical connector 200 can be brought toward the first printed circuit board 206 along the direction 300, and/or the first printed circuit board 206 can be brought toward the electrical connector 200 in a direction opposite the direction 300, such that the relative motion of the electrical connector 200 and the first printed circuit board 206 causes the connector to move relative to the first printed circuit board 206 in the insertion direction 300. As the electrical connector 200 moves along the insertion direction 300, the electrical connector 200 becomes partially engaged to the first printed circuit board 206, whereby the mounting ends 228 of the contacts 204 begin to engage the leading edge 220 of the first printed circuit board 206. In particular, the opposed resilient fingers 232*a-b* can flare away from each other as the mounting ends 228 receive the leading edge 220.

As the electrical contacts 204 engage the leading edge 220, the bottom surface 240 of the first printed circuit board 206 is substantially aligned with the upper surface 241 of the platform 242, and can ride along the upper surface 241 so that the leading edge 220 contacts the engagement surface 255 of the post 250. As the leading edge 220 rides along the beveled engagement surface 255 of the post 250, the leading edge 220 imparts a downward biasing force against the post 250, thereby causing the latch arm 245 to flex downward, which causes the post 250 to translate downward as the leading edge 220 continues to ride along the engagement surface 255. Because the latch arm 245 extends from the platform 242, the platform 242 may remain substantially straight, providing additional stability and guidance to the first printed circuit board 206 while the latch arm 245 flexes.

As the electrical connector 200 continues to translate relative to the first printed circuit board 206 along the insertion direction 300 from the partially engaged position illustrated in FIG. 3B to the fully engaged position illustrated in FIG. 3C, the trailing end of the engagement surface 255 rides along the bottom surface 240 of the first printed circuit board 206, for instance at the corner portion 264 of the first printed circuit board 206. Once the post 250 is aligned with the complementary aperture 256, the latch arm 245 resiliently biases the post 250 upward into the aperture 256 in a locked position. When the post 250 is disposed in the aperture 256, interference between the trailing end of the engagement surface 255 and the inner surface 257 that defines the aperture 256 can prevent the electrical connector 200 from separating from the first printed circuit board 206 along a direction opposite the insertion direction 300. Furthermore, when the electrical connector 200 is fully mounted to the first printed circuit board 206, the corner portion 264 of the first printed circuit board 206 may be received in a respective retention pocket 258.

If it is desired to remove the first printed circuit board 206 from the electrical connector 200, any suitable tool, or a finger if desired, can be inserted into each aperture 256 and apply a downward biasing force against the corresponding engagement surface 255, thereby causing the latch arm 245 to flex down until the post 250 is removed from interference with respect to the aperture 250. The electrical connector 200 can then be separated from the first printed circuit board 206 along a relative motion along a separation direction opposite the insertion direction 300. Thus, it should be appreciated that the retention assemblies 209*a-b* and their components, such as the latch members 244 remain coupled to the connector housing 202 both as the electrical connector 200 is mounted to the first printed circuit board 206, as well as when the electrical connector 200 is separated from the first printed circuit board 206. Thus, it can be said that the retention assemblies 209*a-b* are devoid of removable hardware that secures the electrical connector 200 to the first printed circuit board 206.

The embodiments described in connection with the illustrated embodiments have been presented by way of illustration, and the present invention is therefore not intended to be limited to the disclosed embodiments. Accordingly, those skilled in the art will realize that the invention is intended to encompass all modifications and alternative arrangements included within the spirit and scope of the invention, for instance as set forth by the appended claims

What is claimed:

1. A card-edge connector configured to be mounted to a substrate along an insertion direction, the card-edge connector comprising:

a connector housing that carries a plurality of electrical contacts; and at least one latch member including a latch arm that is connected to the connector housing at a first location, and a latch body extending from the latch arm at a second location that is spaced from the first location along a direction opposite to the insertion direction, wherein the latch body is configured to be inserted into an aperture that extends through the substrate so as to secure the card-edge connector to the substrate.

2. The card-edge connector as recited in claim 1, wherein the retention pocket is disposed laterally outward of the electrical contacts with respect to a direction substantially perpendicular to an insertion direction along which the card-edge connector is mounted to the substrate.

3. The card-edge connector as recited in claim 1, wherein the first end of the latch arm defines a proximal end.

4. The card-edge connector as recited in claim 1, wherein the second end of the latch arm defines a free distal end.

5. The card-edge connector as recited in claim 1, wherein the electrical contacts define respective mounting ends that comprise opposed resilient fingers that are configured to receive the substrate so as to electrically connect the electrical contacts to the substrate.

6. The card-edge connector as recited in claim 1, wherein the electrical contacts comprise electrical signal contacts and electrical power contacts.

7. The card-edge connector as recited in claim 1, further comprising a platform that defines a latch chamber, such that the latch arm extends from the platform in the latch chamber.

8. The card-edge connector as recited in claim 1, wherein the connector housing defines a retention pocket configured to receive a leading edge portion of the substrate when the card-edge connector is mounted to the substrate.

9. The card-edge connector as recited in claim 8, wherein the connector housing defines an internal surface that at least partially defines the pocket and is configured to engage a first side of the substrate, and a platform surface configured to engage a second side of the substrate that is opposite the first side so as to capture the substrate therebetween.

10. The card-edge connector as recited in claim 1, wherein the engagement surface is tapered along the insertion direction.

11. The card-edge connector as recited in claim 10, wherein the latch arm is flexible.

12. A card-edge connector configured to be mounted to a substrate along an insertion direction, the substrate having a mounting aperture, the card-edge connector comprising:

a connector housing that carries a plurality of electrical contacts;

a latch body supported by the connector housing, the latch body defining an engagement surface that includes a leading end and an opposed trailing end along the insertion direction, wherein the engagement surface is tapered such that the trailing end is configured to ride along the substrate until the latch body is biased into the mounting aperture, thereby securing the electrical connector to the substrate.

13. The card-edge connector as recited in claim 12, wherein the connector housing defines a retention pocket configured to receive a leading edge of the substrate when the card-edge connector is mounted to the substrate.

14. A card-edge connector configured to be mounted to a substrate along an insertion direction, the substrate having a mounting aperture and a leading edge, the card-edge connector comprising:

a connector housing that carries a plurality of electrical contacts; and a retention assembly supported by the connector housing, the retention assembly including a platform defining a platform surface configured to abut a surface of the substrate, and a latch member having a latch body that is configured to fit inside the mounting aperture, the latch body defining an engagement surface that is configured to be displaced by the leading edge of the substrate as the card-edge connector is mounted to the substrate, and subsequently biased from the surface of the substrate into the mounting aperture of the substrate when the card-edge connector is mounted to the substrate.

15. The card-edge connector as recited in claim 14, wherein the retention assembly is a first retention assembly, and the card edge connector further comprises a second retention assembly constructed substantially identical to the first retention assembly, such that the electrical contacts extend between the first and second retention assemblies.

* * * * *